US008011384B2

(12) United States Patent
Izzy et al.

(10) Patent No.: US 8,011,384 B2
(45) Date of Patent: Sep. 6, 2011

(54) BRIDGE FAUCET

(75) Inventors: Zuhair A. Izzy, Carmel, IN (US); Scott K. Jones, Westfield, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 406 days.

(21) Appl. No.: 12/082,008

(22) Filed: Apr. 8, 2008

(65) Prior Publication Data

US 2009/0250127 A1 Oct. 8, 2009

(51) Int. Cl.
*F16K 11/20* (2006.01)
*F16K 21/00* (2006.01)
*E03C 1/04* (2006.01)

(52) U.S. Cl. ..... 137/606; 137/801; 4/678

(58) Field of Classification Search ..... 137/606, 137/801; 4/678, 675
See application file for complete search history.

(56) References Cited

U.S. PATENT DOCUMENTS

| | | | | |
|---|---|---|---|---|
| 1,181,370 | A * | 5/1916 | Brown | 137/606 |
| 1,583,944 | A | 5/1926 | Van Eweyk | |
| 1,647,190 | A | 11/1927 | Mueller | |
| 1,676,800 | A | 7/1928 | Richards et al. | |
| 1,680,119 | A | 8/1928 | Schulder | |
| 2,262,291 | A | 11/1941 | Kuhnle | |
| 2,579,938 | A * | 12/1951 | Liebhart et al. | 137/606 |
| 2,581,855 | A | 1/1952 | Griffith | |
| 2,830,618 | A | 4/1958 | Mitchell | |
| 3,448,768 | A | 6/1969 | Keller, III | |
| 4,026,328 | A * | 5/1977 | Nelson | 137/801 |
| 4,852,192 | A * | 8/1989 | Viegener | 4/678 |
| 5,669,417 | A | 9/1997 | Lian-Jie | |
| 5,797,151 | A | 8/1998 | Ko | |
| 5,960,490 | A | 10/1999 | Pitsch | |
| 5,979,489 | A | 11/1999 | Pitsch | |
| 6,023,796 | A | 2/2000 | Pitsch | |
| 6,079,061 | A | 6/2000 | Fan | |
| 6,161,230 | A | 12/2000 | Pitsch | |
| 6,170,098 | B1 * | 1/2001 | Pitsch | 4/678 |
| 6,467,104 | B1 | 10/2002 | Shieh | |
| 7,121,303 | B1 | 10/2006 | Hwang | |
| 7,216,663 | B2 * | 5/2007 | Vu | 137/119.04 |
| 7,698,755 | B2 * | 4/2010 | McNerney et al. | 4/695 |
| 2006/0124183 | A1 | 6/2006 | Kuo | |
| 2006/0180220 | A1 * | 8/2006 | Ko | 137/801 |

* cited by examiner

*Primary Examiner* — Stephen M Hepperle
*Assistant Examiner* — Atif Chaudry
(74) *Attorney, Agent, or Firm* — Baker & Daniels LLP

(57) ABSTRACT

A bridge faucet assembly including a hot water pillar, a cold water pillar positioned in spaced relation to the hot water pillar, and a bridge fluidly coupled to the hot water pillar and the cold water pillar. A spout is supported by the bridge and includes an internal passageway. A coupler is at least partially received within the internal passageway of the spout and is configured to couple the spout to the bridge.

18 Claims, 5 Drawing Sheets

BRIDGE FAUCET

BACKGROUND AND SUMMARY OF THE INVENTION

The present invention relates generally to a faucet including a spout mounted to a base and, more particularly, to a bridge faucet assembly including a spout mounted to a bridge through an internally disposed coupler.

Conventional bridge faucet assemblies include a hot water pillar receiving a hot water control valve, and a cold water pillar receiving a cold water control valve. A bridge extends between the hot water pillar and the cold water pillar, and is positioned in spaced relation above a sink mounting deck. A spout is supported by the bridge member and delivers water from the hot water pillar and the cold water pillar to an outlet. In conventional bridge faucet assemblies, the hot water pillar and the cold water pillar are typically formed of brass and are coupled to the bridge through either external mechanical couplings or brazing. Similarly, the spout is typically formed of brass and coupled to the bridge through an external mechanical coupling or brazing.

According to an illustrative embodiment of the present disclosure, a bridge faucet assembly is configured to be coupled to a mounting deck. The bridge faucet assembly includes a hot water pillar, a cold water pillar positioned in spaced relation to the hot water pillar, and a bridge fluidly coupled to the hot water pillar and the cold water pillar. The bridge is positioned intermediate the hot water pillar and the cold water pillar, and in spaced relation above the mounting deck. A spout is supported by the bridge, and a coupler is at least partially received within an internal passageway of the spout The coupler is configured to couple the spout to the bridge.

According to another illustrative embodiment of the present disclosure, a faucet assembly includes a base, and a spout supported by the base. The spout includes a fluid passageway and a tool access opening. A coupler includes a body extending between opposing proximal and distal ends, the body being at least partially received within the fluid passageway. The distal end of the body is secured to the base and the proximal end of the body is accessible from outside the spout through the tool access opening. A seal is configured to cooperate with the spout to prevent fluid flow from the fluid passageway through the tool access opening.

According to yet another illustrative embodiment of the present disclosure, a bridge faucet assembly is configured to be coupled to a mounting deck and includes a hot water pillar and a cold water pillar positioned in spaced relation to the hot water pillar. A bridge fluidly couples the hot water pillar and the cold water pillar. The bridge includes a mounting hub positioned intermediate the hot water pillar and the cold water pillar, and is in spaced relation above the mounting deck. The mounting hub includes an internal hub waterway. A spout is supported by the mounting hub of the bridge and includes an internal spout waterway fluidly coupled to the internal hub waterway. A coupler includes a body having opposing proximal and distal ends, the proximal end being connected to the spout, and the distal end being connected to the mounting hub. The body is at least partially received within the internal spout waterway and the internal hub waterway such that the body is in contact with water flowing therethrough.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
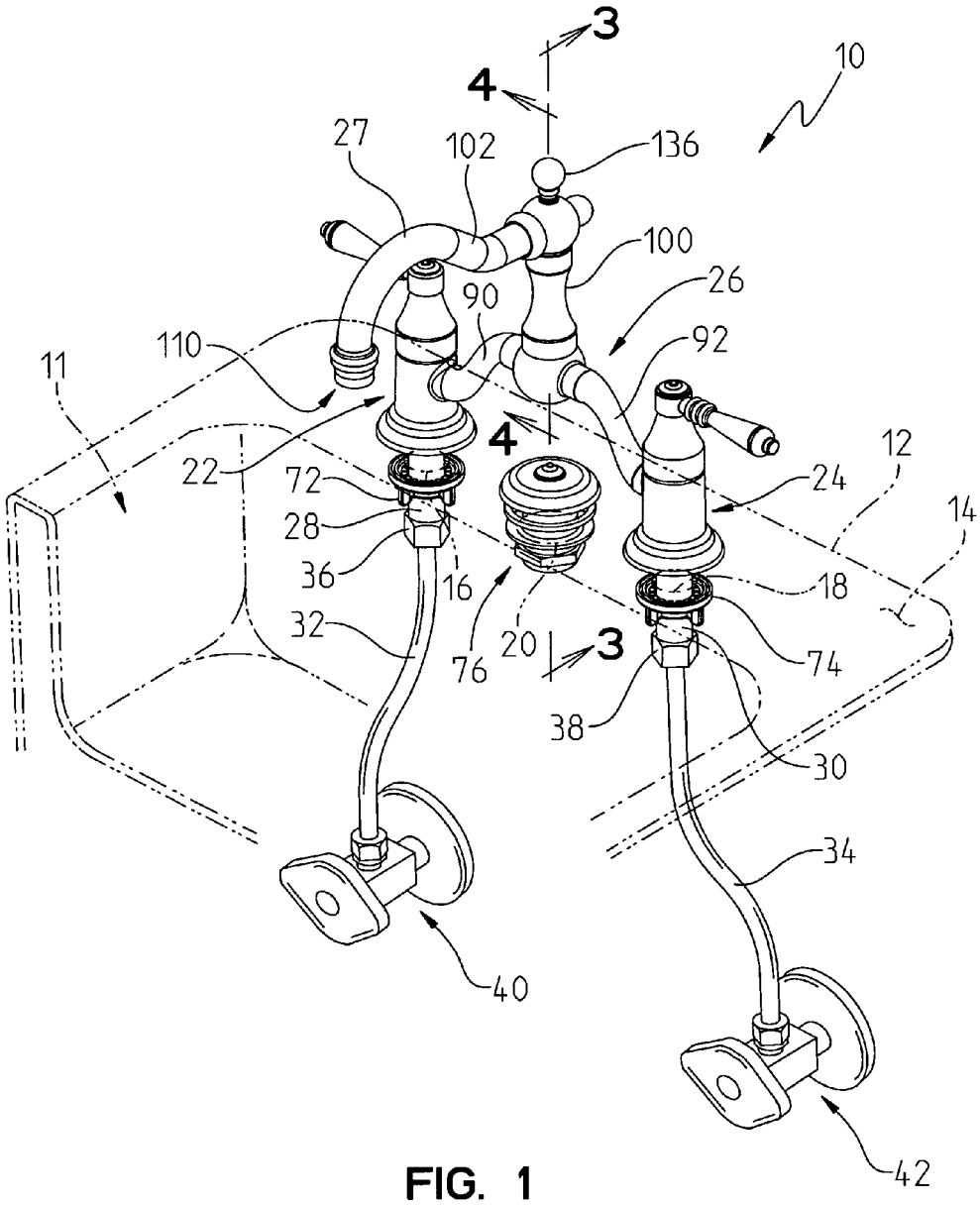
FIG. 1 is a perspective view of an illustrative bridge faucet assembly according to the present disclosure as coupled to a sink mounting deck.

Referring initially to FIG. 1, an illustrative bridge faucet assembly 10 for delivering water to a sink basin 11 is shown coupled to a sink mounting deck 12. In the illustrative embodiment, the sink mounting deck 12 includes a mounting surface 14 having a plurality of mounting holes 16, 18 and 20 extending therethrough. More particularly, a hot water pillar 22 and a cold water pillar 24 are positioned in spaced relation within mounting holes 16 and 20, respectively, and extend above the deck mounting surface 14. A bridge 26 extends between the hot water pillar 22 and the cold water pillar 24, in spaced relation above the deck mounting surface 14. A delivery spout 27 is supported by the bridge 26 and includes an outlet 29 for delivering water to the sink basin 11.

Figure 2:
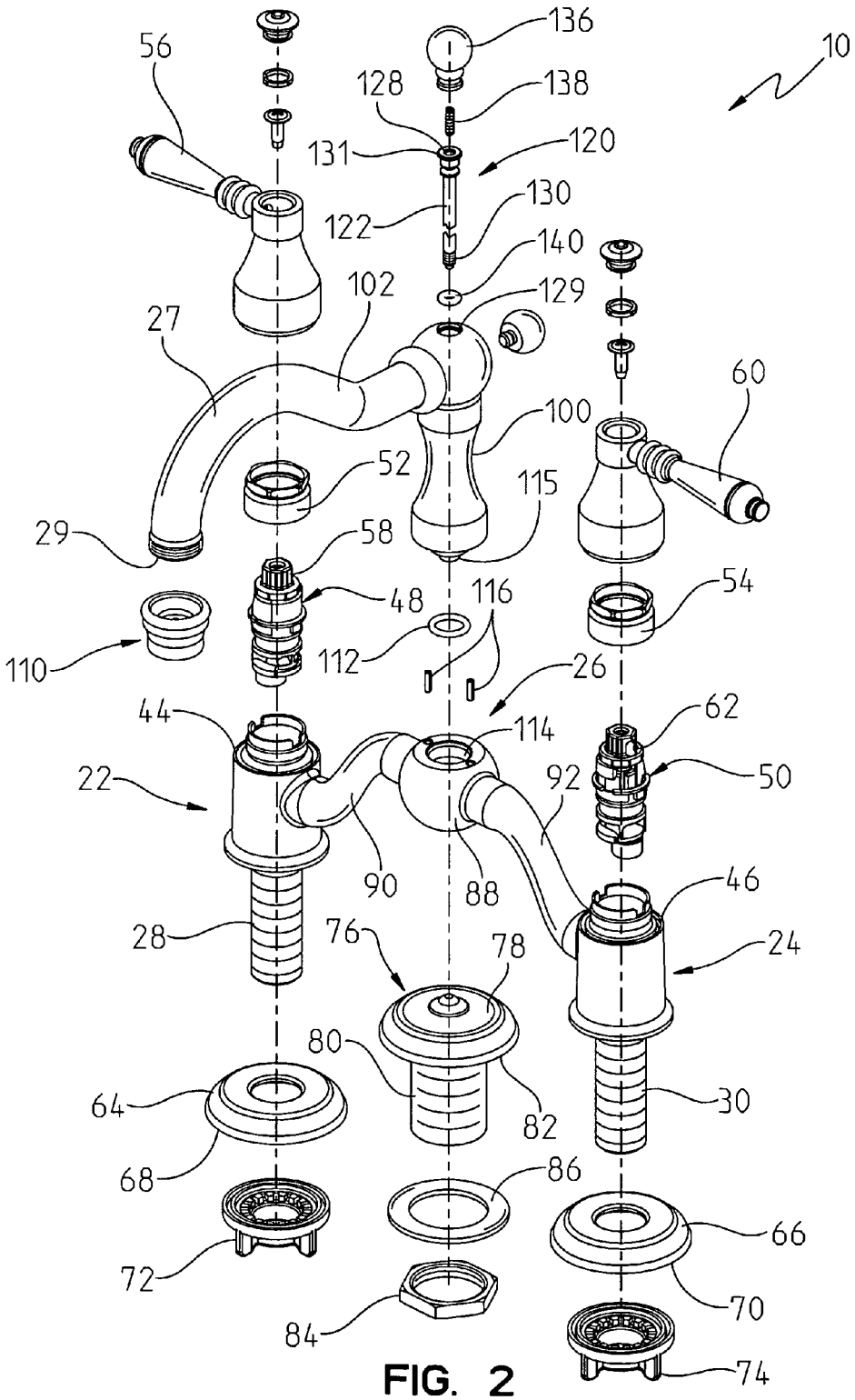
FIG. 2 is an exploded perspective view of the bridge faucet assembly of FIG. 1.

With reference to FIGS. 1 and 2, the hot water pillar 22 includes a threaded tubular connector 28 extending down from the mounting deck 12 through mounting hole 18, while cold water pillar 24 includes a similar threaded tubular connector 30 extending down from the mounting deck 12 through mounting hole 20. Conventional water lines 32 and 34 include conventional connections 36 and 38 to couple the hot water pillar 22 and the cold water pillar 24 to hot and cold water supplies, illustratively hot and cold water stops 40 and 42, respectively.

Figure 3:
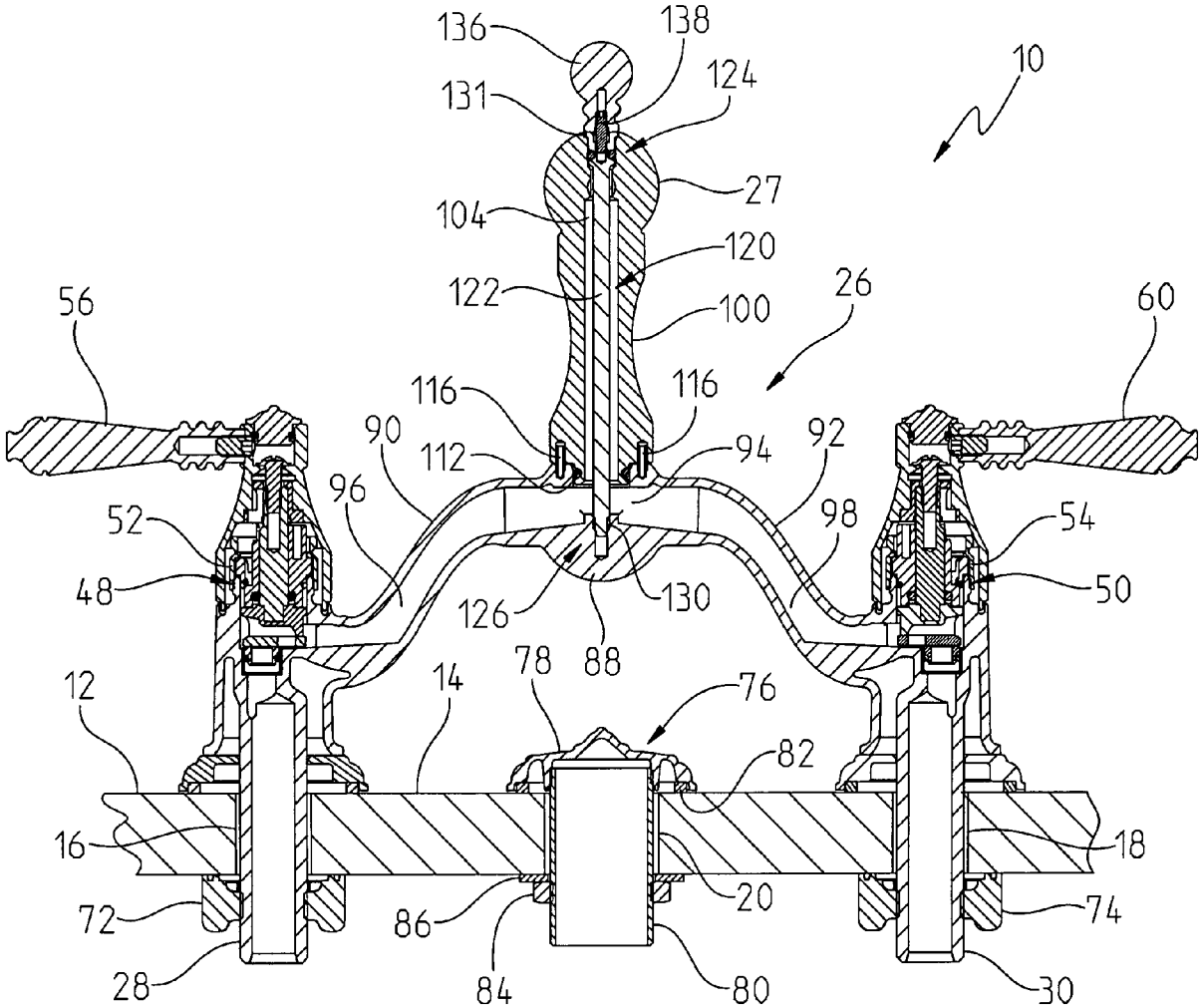
FIG. 3 is a cross-sectional view taken along line 3-3 of FIG. 1.

Referring to FIGS. 2 and 3, the hot water pillar 22 includes a hot water valve body 44, and the cold water pillar 24 includes a cold water valve body 46. A hot water control valve 48 is received within the hot water valve body 44, and a cold water control valve 50 is received within the cold water valve body 46. The control valves 48 and 50 may be of conventional design for controlling the flow of water from the water lines 32 and 34, respectively, to the bridge 26. Bonnet nuts 52 and 54 secure the control valves 48 and 50 within the respective valve bodies 44 and 46. A hot water handle 56 is coupled to a stem extension 58 of the hot water control valve 48, and a cold water handle 60 is coupled to a stem extension 62 of the cold water control valve 50. A first escutcheon 64 and a second escutcheon 66 are concentrically received around the hot water pillar 22 and cold water pillar 24, respectively. Gaskets 68 and 70 are illustratively positioned intermediate the escutcheons 64 and 66 and the mounting surface 14. Mounting nuts 72 and 74 are threadably received on the connectors 28 and 30 and are configured to secure the hot water and cold water pillars 22 and 24, respectively, to the mounting deck 12.

Figure 4:
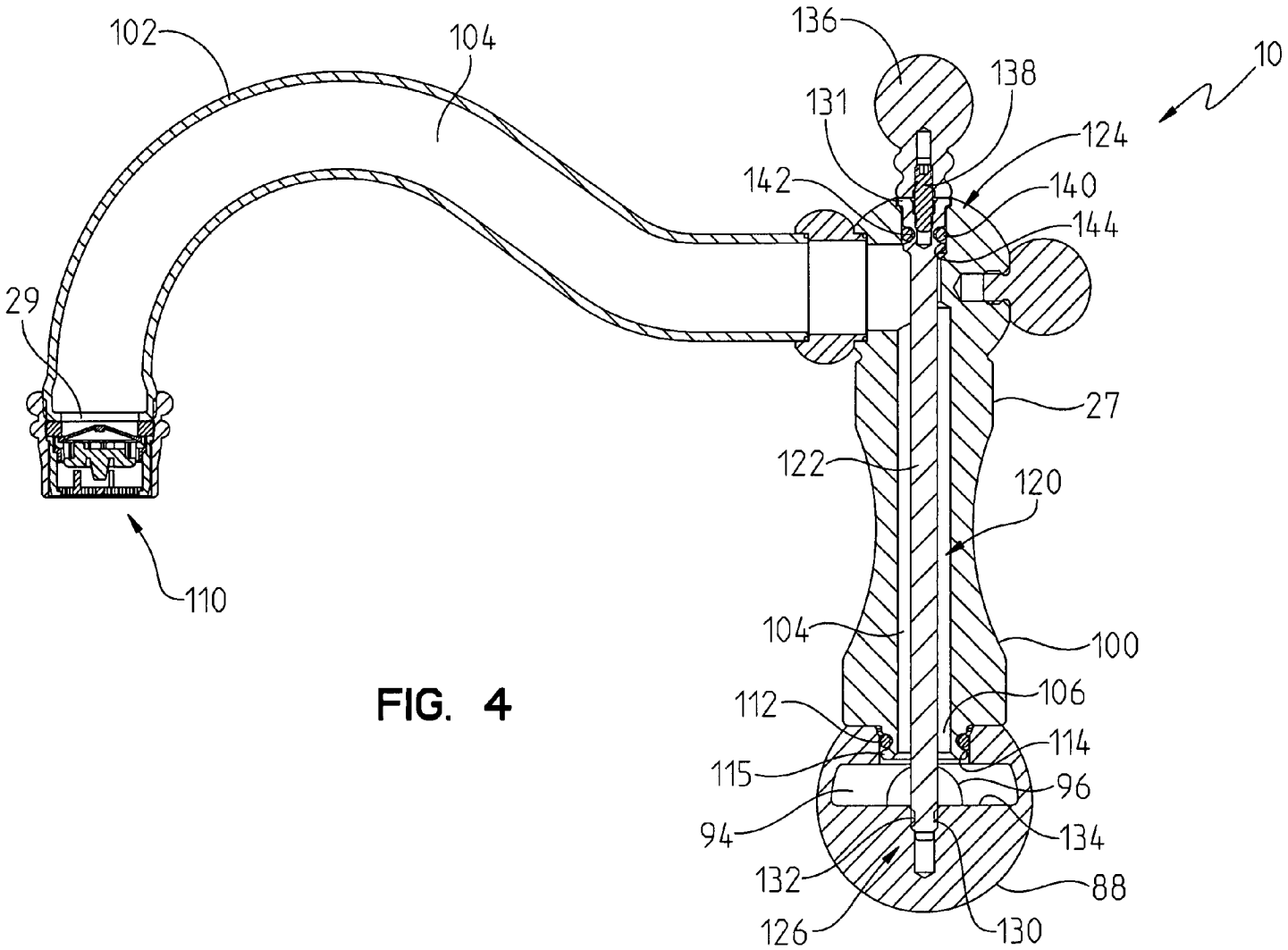
FIG. 4 is a partial cross-sectional view taken along line 4-4 of FIG. 1.

With reference to FIGS. 2-4, in illustrative embodiments where sink mounting deck 12 includes a third mounting hole 20 positioned intermediate the first and second mounting holes 16 and 18, a cover assembly 76 may be utilized. The cover assembly 76 includes an upper cover 78 including a threaded mounting shaft 80 extending downwardly therefrom. A gasket 82 may be positioned intermediate the upper cover 78 and the deck mounting surface 14. A mounting nut 84 is threadably received on the shaft 80 and is configured to secure the upper cover 78 and a washer 86 to the mounting deck 12.

The bridge 26 includes a mounting hub 88 positioned intermediate the hot and cold water pillars 22 and 24 by connecting arms 90 and 92. The mounting hub 88 includes an internal hub waterway 94 which is fluidly coupled to the hot and cold water control valves 48 and 50. More particularly, internal waterways 96 and 98 formed within connecting arms 90 and 92 are in fluid communication with internal hub waterway 94. The spout 27 is supported by the mounting hub 88 of the bridge 26 and includes a riser 100 and delivery tube 102. An internal spout waterway 104 extends through the riser 100 and delivery tube 102 and has an inlet 106 fluidly coupled to the internal hub waterway 94. Outlet 29 of spout waterway 104 may receive a conventional aerator assembly 110 configured to deliver water to the sink basin 11.

A seal 112, illustratively an o-ring, is received within an opening 114 formed within the mounting hub 88. The o-ring 112 provides sealing engagement between a mounting extension 115 of the spout 27 and the mounting hub 88 of the bridge 26. A pair of diametrically opposed locating members 116, illustratively spring pins, extend upwardly from the mounting hub 88. The pins 116 facilitate proper angular orientation of the spout 27 on the bridge 26.

Figure 5:
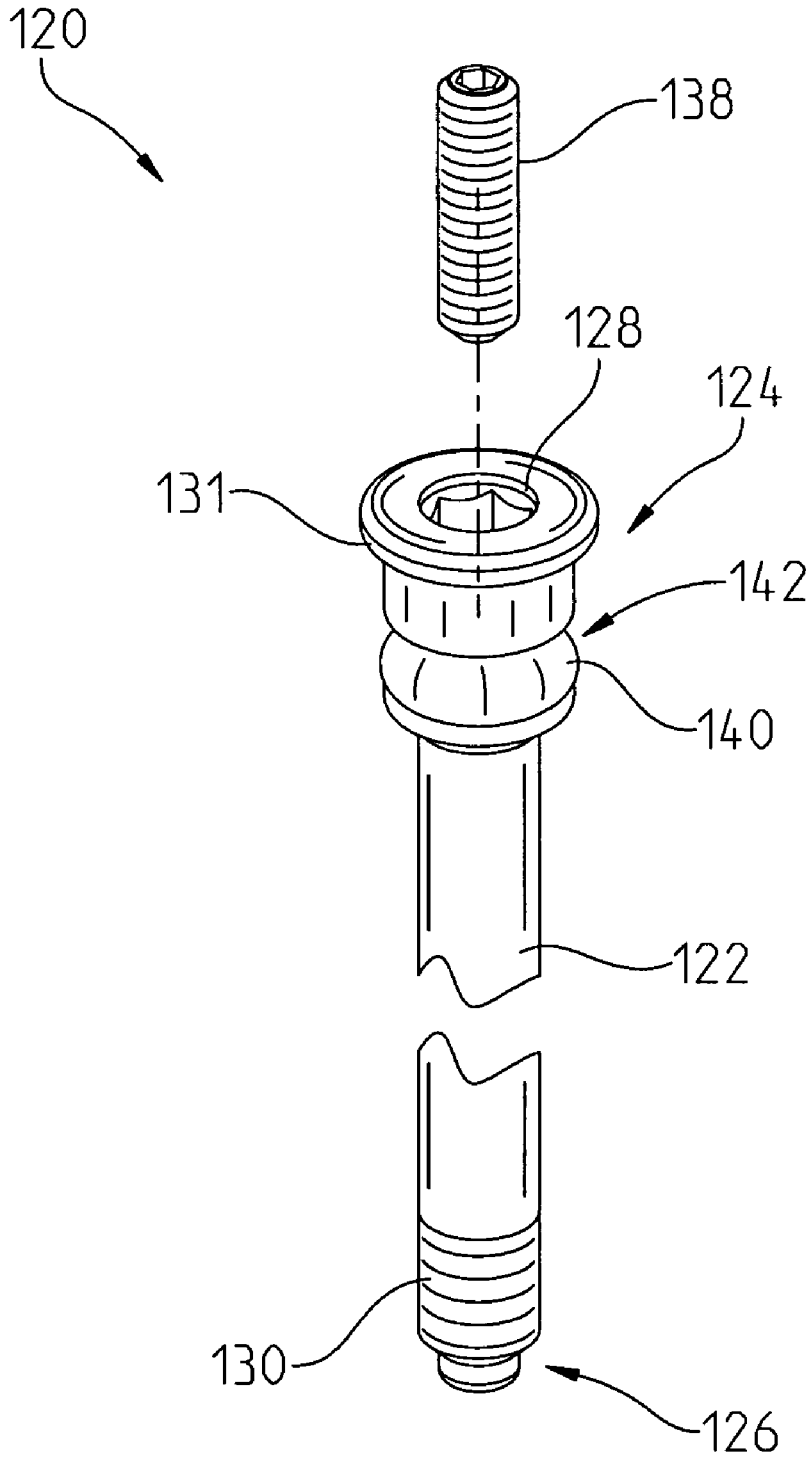
FIG. 5 is a partially exploded perspective view of the coupler of the bridge faucet assembly of FIG. 2.

With reference to FIGS. 2-5, a coupler 120 is configured to secure the spout 27 to the bridge 26. More particularly, the coupler 120 includes a body 122 having opposing proximal and distal ends 124 and 126. The proximal end 124 includes a tool engaging member 128, illustratively a hex socket to receive a conventional Allen wrench (FIG. 5). A tool access opening 129 is formed at an upper end of the spout riser 100 to provide access to the tool engaging member 128. A lip or flange 131 is supported at the proximal end 124 and is configured to engage the spout 27. The distal end 126 includes an externally threaded portion 130 for receipt within an internally threaded aperture 132 formed in the bottom 134 of the mounting hub 88. Cooperation between the flange 131 of the proximal end 124 and the threaded portion 130 of the distal end 126, permits the coupler 120 to secure the spout 27 to the bridge 26.

As further illustrated in FIGS. 4 and 5, the body 122 of the coupler 120 is at least partially received with both the internal spout waterway 104 formed within the riser 100 and within the internal hub waterway 94 formed within the mounting hub 88 of the bridge 26. Moreover, the coupler 120 is concealed within the final bridge faucet assembly 10. A finial 136 covers the tool access opening 129 within the spout 27 to hide the distal end 126 of the coupler 120 from view. More particularly, a first end of a threaded shaft 138, illustratively a set screw, is threadably received within the distal end 126 of the coupler 120. The finial 136 threadably engages an opposing second end of the threaded shaft 138.

Since the coupler 120 is internally disposed within the hub and spout waterways 94 and 104, a seal 140, illustratively an o-ring, is provided to prevent water leakage through the tool access opening 129. The o-ring 140 is illustratively concentrically received within a groove 142 formed on the distal end 126 of the coupler 120 and engages a valve seat 144 formed in the access opening 129 of the spout 27.

As noted above, the coupler 120 is concealed from view. Similarly, visible connections between the hot water and cold water pillars 22 and 24 and the bridge 26 have been eliminated. More particularly, the hot water and cold water pillars 22 and 24 may be formed as an integral casting with the bridge 26, thereby defining a single body with no externally visible connections.

Although the invention has been described in detail with reference to certain preferred embodiments, variations and modifications exist within the spirit and scope of the invention as described and defined in the following claims.

The invention claimed is:

1. A bridge faucet assembly configured to be coupled to a mounting deck, the bridge faucet assembly comprising:

a hot water pillar including a first valve for controlling the flow of hot water;

a cold water pillar positioned in spaced relation to the hot water pillar, the cold water pillar including a second valve for controlling the flow of cold water;

a bridge fluidly coupled to the hot water pillar and the cold water pillar, the bridge including a mounting hub having a hub waterway positioned intermediate the hot water pillar and the cold water pillar and in spaced relation above the mounting deck;

a spout supported by the mounting hub of the bridge and including an internal passageway fluidly coupled to the hub waterway, the spout including a spout riser, a delivery tube, and a tool access opening in an upper end of the spout riser; and a coupler including opposing proximal and distal ends and extending through the internal passageway of the spout riser from an upper end of the spout riser to a lower end of the spout riser and across the hub waterway, the coupler being configured to couple the spout to the bridge, the proximal end of the coupler including a tool engaging member received within the tool access opening of the spout riser and accessible from above by a tool, and the distal end of the coupler including an externally threaded portion received within an internally threaded aperture in the bottom of the mounting hub.

2. The bridge faucet assembly of claim 1, wherein the hot water pillar, the cold water pillar and the bridge are integrally formed as a single cast body.

3. The bridge faucet assembly of claim 1, wherein the internal passageway comprises a waterway extending through the spout to convey water from the bridge to an outlet, at least a portion of the coupler received within the waterway and in contact with water passing therethrough.

4. The bridge faucet assembly of claim 3, wherein the coupler includes opposing proximal and distal ends, and a seal is positioned at the proximal end of the coupler and sealingly engages the spout.

5. The bridge faucet assembly of claim 1, further comprising a seal positioned intermediate the mounting hub and the spout.

6. The bridge faucet assembly of claim 1, further comprising a threaded shaft extending from the proximal end, and a finial threadably coupled to the shaft.

7. The bridge faucet assembly of claim 1, further comprising:

a hot water control valve received within the hot water pillar; and a cold water control valve received within the cold water pillar.

8. A bridge faucet assembly configured to be coupled to a mounting deck, the bridge faucet assembly comprising:

a hot water pillar including a first valve for controlling the flow of hot water;

a cold water pillar positioned in spaced relation to the hot water pillar, the cold water pillar including a second valve for controlling the flow of cold water;

a bridge fluidly coupled to the hot water pillar and the cold water pillar, the bridge positioned intermediate the hot water pillar and the cold water pillar and in spaced relation above the mounting deck;

a spout supported by the bridge;

a coupler at least partially received within an internal passageway of the spout, the coupler being configured to couple the spout to the bridge; and wherein the bridge includes a mounting hub, the spout being supported by the mounting hub, and a plurality of locating members are positioned intermediate the mounting hub and the spout to facilitate proper orientation therebetween.

9. A faucet assembly comprising:

a base including a mounting hub having a hub waterway;

a spout supported by the mounting hub of the base and including a spout riser, a delivery tube, a fluid passageway extending through the spout riser and the delivery tube, and a tool access opening formed with an upper end of the spout riser;

a coupler including a body extending between opposing proximal and distal ends, the body inserted from an upper end of the spout riser, extending within the fluid passageway of the spout riser and extending across the hub waterway, the body being operable to rotate within the fluid passageway of the spout riser, the distal end being secured to the mounting hub of the base, and the proximal end being accessible from outside the spout through the tool access opening and configured to receive a tool inserted into the tool access opening to rotate the coupler, the proximal end of the coupler including a tool engaging member received within the tool access opening of the spout riser and accessible from above by a tool, and the distal end of the coupler including an externally threaded portion received within an internally threaded aperture in the bottom of the mounting hub; and a seal configured to cooperate with the spout to prevent fluid flow from the fluid passageway through the tool access opening.

10. The faucet assembly of claim 9, further comprising a hot water pillar and a cold water pillar, wherein the base comprises a bridge fluidly coupled to the hot water pillar and the cold water pillar, the bridge being positioned intermediate the hot water pillar and the cold water pillar and in spaced relation above a mounting deck.

11. The faucet assembly of claim 10, wherein the hot water pillar, the cold water pillar and the bridge are integrally formed as a single cast body.

12. The faucet assembly of claim 10, wherein the bridge includes the mounting hub, the spout being fluidly coupled to the mounting hub, and a seal is positioned intermediate the mounting hub and the spout.

13. The faucet assembly of claim 9, wherein the seal comprises an o-ring concentrically supported by the proximal end of the coupler.

14. The faucet assembly of claim 13, wherein the distal end of the coupler includes a plurality of external threads received within a threaded aperture of the base.

15. The faucet assembly of claim 9, further comprising a tool engaging member supported by the proximal end of the coupler, and a plurality of threads supported by the distal end of the coupler.

16. The faucet assembly of claim 9, further comprising a finial coupled to the proximal end of the coupler.

17. A faucet assembly comprising:

a base;

a spout supported by the base and including a fluid passageway and a tool access opening;

a coupler including a body extending between opposing proximal and distal ends, the body at least partially received within the fluid passageway and operable to rotate within the spout, the distal end being secured to the base, and the proximal end being accessible from outside the spout through the tool access opening and configured to receive a tool inserted into the tool access opening to rotate the coupler;

a seal configured to cooperate with the spout to prevent fluid flow from the fluid passageway through the tool access opening;

a hot water pillar and a cold water pillar, wherein the base includes a bridge fluidly coupled to the hot water pillar and the cold water pillar, the bridge being positioned intermediate the hot water pillar and the cold water pillar and in spaced relation above a mounting deck; and wherein the bridge includes a mounting hub, the spout being supported by the mounting hub, and a plurality of locating members are positioned intermediate the mounting hub and the spout to facilitate proper orientation therebetween.

18. A bridge faucet assembly configured to be coupled to a mounting deck, the bridge faucet assembly comprising:

a hot water pillar including a first valve for controlling the flow of hot water;

a cold water pillar positioned in spaced relation to the hot water pillar, the cold water pillar including a second valve for controlling the flow of cold water;

a bridge fluidly coupled to the hot water pillar and the cold water pillar, the bridge including a mounting hub having a hub waterway positioned intermediate the hot water pillar and the cold water pillar and in spaced relation above the mounting deck, the mounting hub including an internal hub waterway;

a spout supported by the mounting hub of the bridge, the spout including an internal spout waterway fluidly coupled to the internal hub waterway, the spout further including a spout riser, a delivery tube, and a tool access opening in an upper end of the spout riser; and a coupler including a body having opposing proximal and distal ends, the proximal end connected to the spout and including a tool engaging member accessible from above by a tool, the distal end including an externally threaded portion received within an internally threaded aperture in the bottom of the mounting hub, and the body extending through the internal spout waterway between upper and lower ends of the spout riser and across the internal hub waterway such that the body is in contact with water flowing therethrough.

* * * * *